US008276341B1

(12) United States Patent
Pop

(10) Patent No.: US 8,276,341 B1
(45) Date of Patent: Oct. 2, 2012

(54) WALL STRUCTURE WITH EITHER PLASTIC OR CONCRETE HORIZONTAL INTERLOCKING SIDING PANELS

(76) Inventor: Ludovic Pop, Southgate, MI (US)

( * ) Notice: Subject to any disclaimer, the term of this patent is extended or adjusted under 35 U.S.C. 154(b) by 0 days.

(21) Appl. No.: 12/769,386

(22) Filed: Apr. 28, 2010

Related U.S. Application Data

(62) Division of application No. 11/405,078, filed on Apr. 17, 2006, now Pat. No. 7,735,284.

(51) Int. Cl.
*E04B 2/00* (2006.01)

(52) U.S. Cl. ..... 52/426; 52/424

(58) Field of Classification Search ..... 52/426, 52/424, 425
See application file for complete search history.

(56) References Cited

U.S. PATENT DOCUMENTS 1,071,467 A * 8/1913 Savage ..... 52/250
1,596,404 A * 8/1926 Clouser ..... 52/562
1,914,770 A * 6/1933 Duncan ..... 52/426

* cited by examiner

*Primary Examiner* — Jeanette E Chapman
*Assistant Examiner* — Daniel Kenny
(74) *Attorney, Agent, or Firm* — Vincent Re PLLC

(57) ABSTRACT

A wall structure for either a building or a stand alone wall is formed with stacked horizontal elongated panels. The upper and lower faces of each panel interlocks with its neighboring panel with a tongue and groove joint to form a continuous wall surface.

12 Claims, 6 Drawing Sheets

WALL STRUCTURE WITH EITHER PLASTIC OR CONCRETE HORIZONTAL INTERLOCKING SIDING PANELS

CROSS-REFERENCE TO RELATED APPLICATIONS

This application is a divisional application of U.S. application Ser. No. 11/405,078 filed on Apr. 17, 2006.

BACKGROUND AND SUMMARY OF THE INVENTION

This invention is directed toward a method and structure for covering a wall with horizontal siding to create a simulated brick wall appearance.

Framed buildings may be erected relatively cheaply and quickly in comparison with buildings using conventional brick laying techniques. However, the use of siding, instead of brick, provides an inexpensive way for covering such a wall. The present invention is related to a novel siding for forming a simulated brick wall.

An example of prior art interested in providing interlocking siding to form a wall may be found in U.S. Pat. No. 6,421,974 issued Jul. 23, 2002, to Nickolas A. Whitehouse et al. for "Cladding".

In one embodiment of the invention, plastic panels are mounted on metal clips that are screwed to an upright support, such as a wall. The metal clips are arranged in horizontal rows one above the other. The clips may be horizontally spaced a typical distance between the studs, such as 16" apart. Each clip has a vertical body that is attached to the wall, a horizontal flange at the lower end of the body, and a downward lip at the outer edge of the flange.

The siding panels are six to eight feet in length, and have an outer surface covered with a material that simulates a brick surface. The inner surface is relatively flat and abuts the metal clips.

Each panel is stacked in a tongue and groove relationship with a lower panel. The panels are stacked using the flange and lip of each clip. A professional grade seamer caulking between each pair of panels makes a waterproof structure.

The arrangement is such that once the clips are installed, each individual panel can be horizontally slid into a retained position with the clips.

The plastic panels can also be made in the form of a six-foot by eight-foot sheet rather than several individual elongated panels.

Another embodiment of the invention uses concrete panels that are not attached to a building wall, but are used to form an upright, self-supporting wall. In this case the panels are interlocked, one above the other, without the use of clips. The panels are stacked in two spaced parallel walls forming an opening between them for receiving concrete. An elongated clamping bar connects both walls to prevent one wall from separating from the other as the concrete is being poured.

Still another form of the invention uses one-piece concrete blocks each having two outer simulated brick faces. The blocks are stacked with mortar laid between each pair. To accommodate their greater weight, concrete blocks are shorter than plastic blocks. Concrete blocks with only a single brick face may also be used.

The preferred siding is relatively quick to assemble, inexpensive and can be exposed to the elements for long periods of time without damage.

Still further objects and advantages of the invention will become readily apparent to those skilled in the art to which the invention pertains upon reference to the following detailed description:

BRIEF DESCRIPTION OF THE DRAWINGS

The description refers to the accompanying drawings in which like reference characters refer to like parts throughout the several views, and in which.

DETAIL DESCRIPTION OF THE INVENTION

Figure 1:
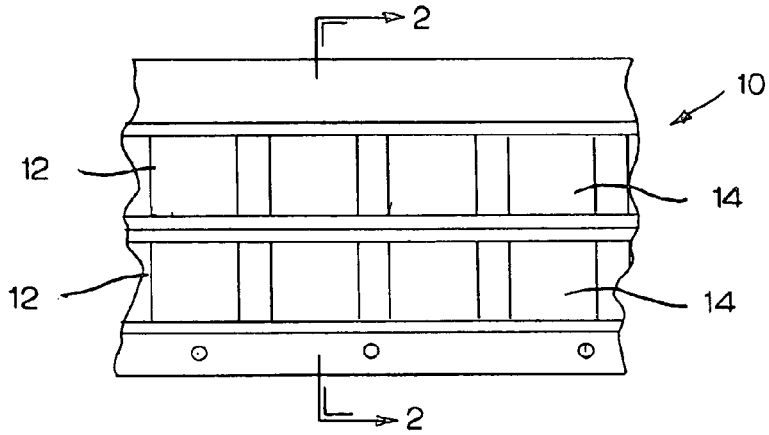
FIG. 1 illustrates a wall assembled from horizontal interlocking plastic siding panels illustrating the preferred embodiment of the invention.
Figure 2:
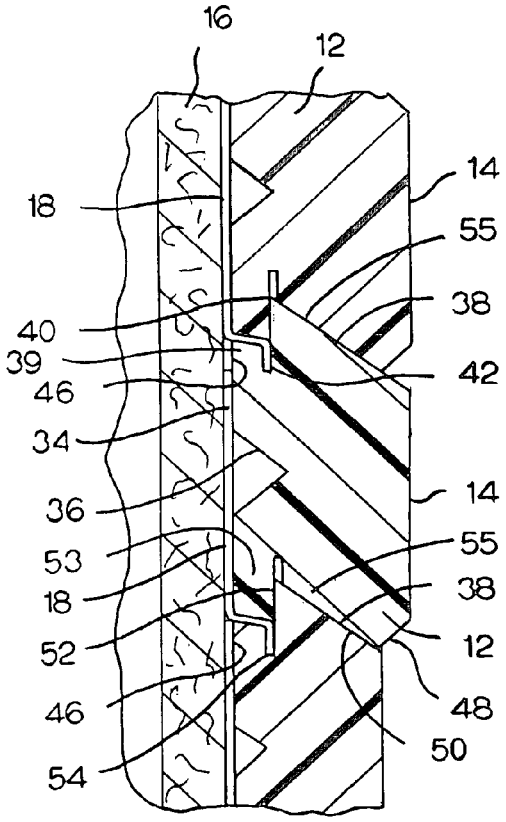
FIG. 2 is an enlarged cross-sectional view as seen along lines 2-2 of FIG. 1.
Figure 3:
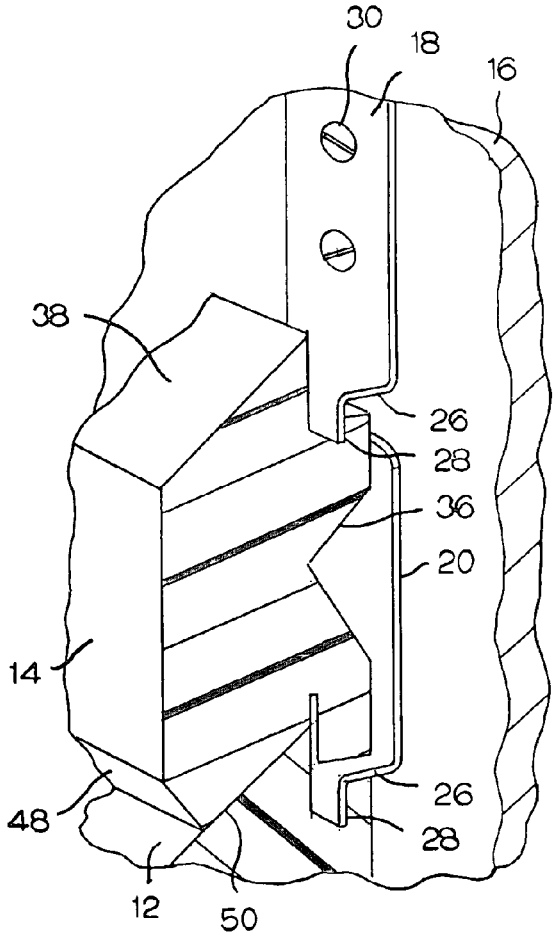
FIG. 3 is an enlarged cross-sectional view of a typical plastic panel illustrating how it is retained in position by a pair of metal clips.
Figure 4:
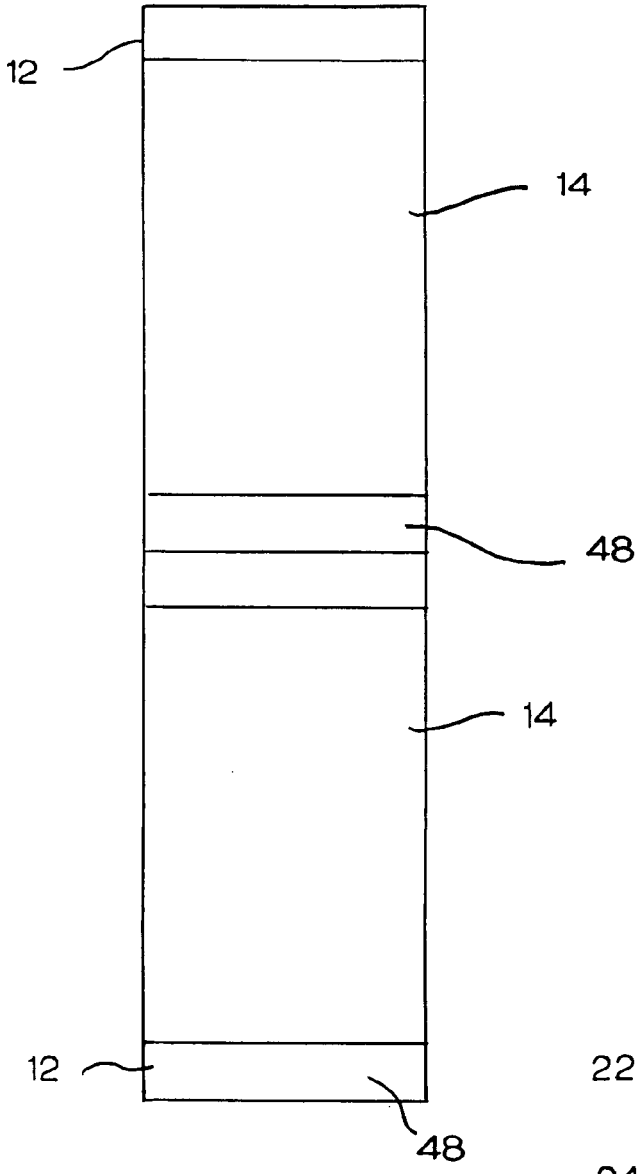
FIG. 4 is an elevational view of a pair of siding panels.

FIGS. 1-3 illustrate a wall 10 formed by several tongue-and-groove siding panels 12. Each panel 12 has a series of outer flat faces 14 coated to form a simulated brick appearance.

This embodiment of the invention is mounted on an upright support 16, which may be a plywood panel or a stud.

Figure 5:
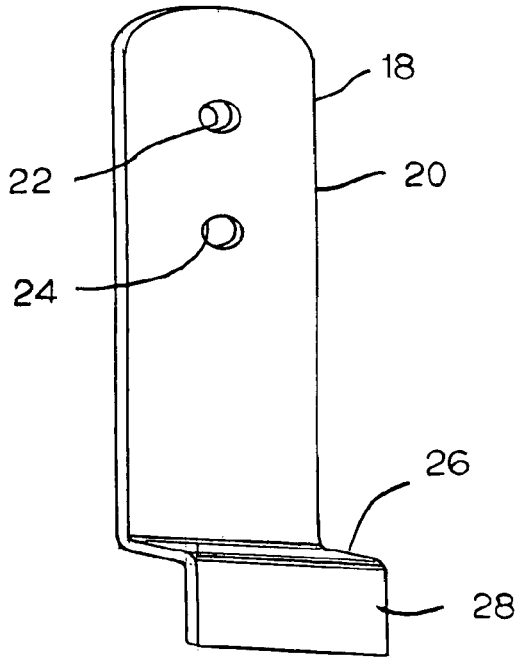
FIG. 5 is a perspective view of a typical clip.
Figure 6:
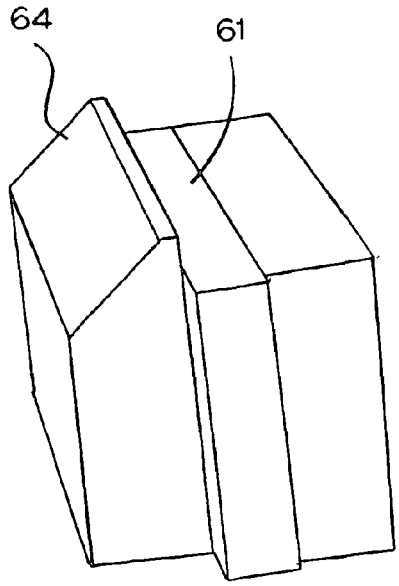
FIGS. 6-9 illustrate the components used in assembling a corner structure.
Figure 7:
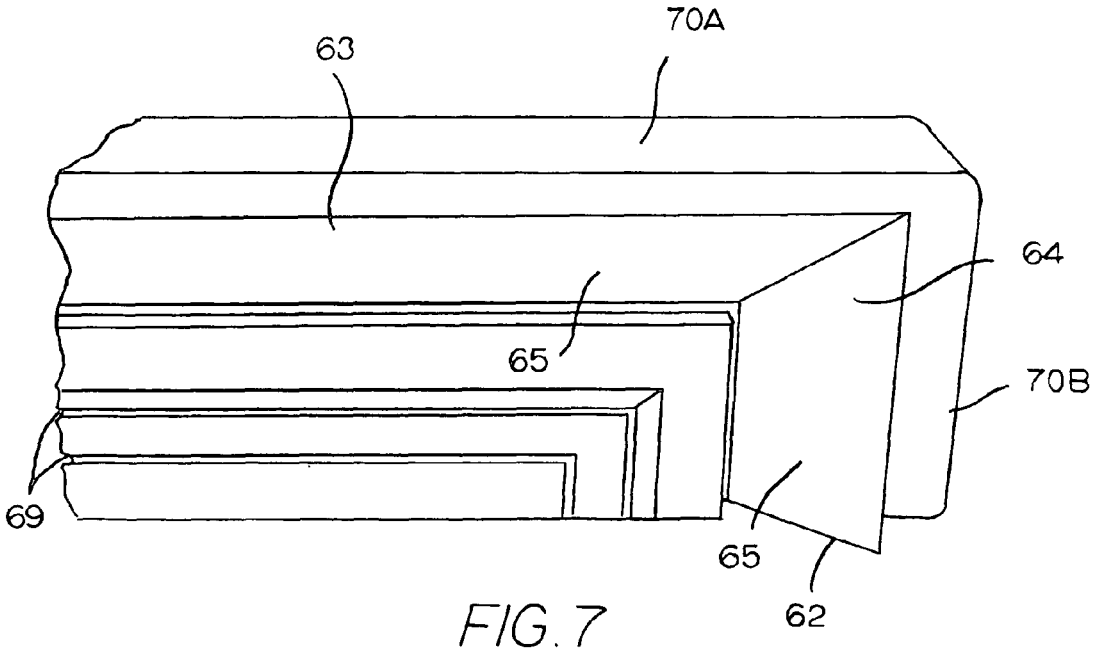
Figure 8:
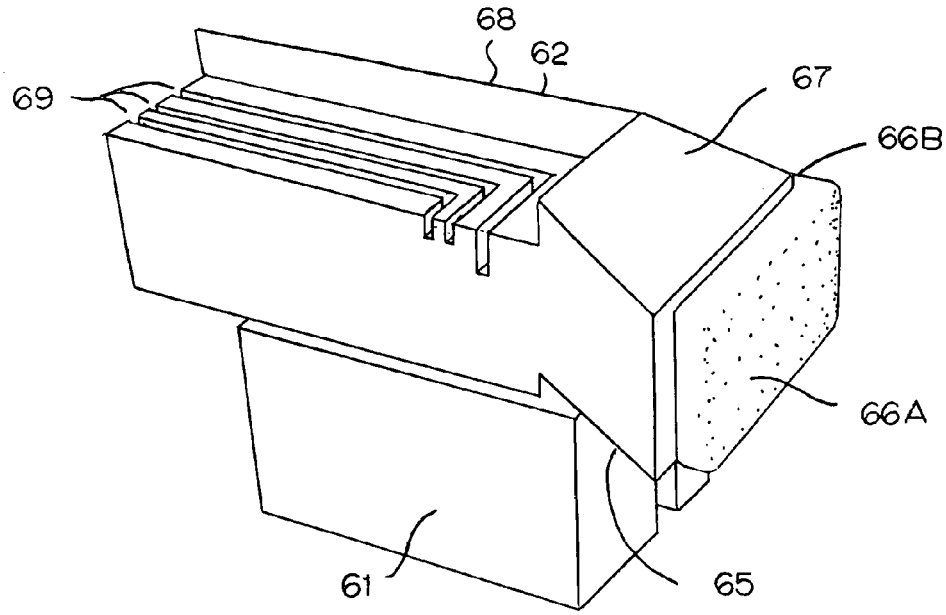

A plurality of metal clips 18 are attached in vertical rows on upright support 16. The clips in each row are horizontally spaced 16" apart. A typical clip is illustrated in FIG. 5 and includes a planar body 20 with fastener holes 22 and 24 for attaching body 20 to the upright support. The clip further includes a horizontal flange 26 attached to the lower end of the body, and a downwardly depending lip 28 disposed in a plane that is parallel to the plane of body 20.

Referring to FIG. 3, the clips are attached to upright support 16 using rustproof screws 30. Each screw is screwed into the support at a 30° angle with respect to an imaginary horizontal line. The screws, preferably Phillips square-drive screws formulated for pressure-treated lumber, such as 8-1¼" square drive screws.

Referring to FIGS. 2 and 3, each siding panel 12 is preferably about eight feet long, 1.5" thick and 3.5" wide. The siding panels may be made of any suitable plastic or composite material that is lightweight, inexpensive, and which can be easily installed on the clips, such as 100% High Density Polyethylene.

The outer flat faces 14 of each panel are parallel to an inner flat face 34. The inner face has a longitudinally running slot 36 which combines with the upright support to form a triangularly shaped, horizontal air passage between the panel and the upright support.

An upper flat face 38 forms an obtuse angle, preferably 135°, with respect to outer face 14. Flat face 38 terminates about 0.5" from inner face 34. A flat surface 40, parallel to inner face 34, extends downwardly about 1" from the apex of face 38 to form a panel lip 39. Surface 40 terminates at the bottom of a slot 42 which has a thickness slightly greater than that of lip 28 of the metal clip. The inner face of the panel can be slid into a channel 46 formed between lip 28 and the upright support.

Each panel has a lower narrow flat surface 48 about ⅜" wide and formed at an angle about 45° with respect to the plane of the outer face of the panel. The lower surface then continues inwardly to form another flat surface 50 that is parallel to upper surface 38. Flat surface 50 slidably abuts the upper surface of a lower panel. Surface 50 continues inwardly to a flat surface 52 that lies in a plane parallel to the inner face 34 and coplanar with flat surface 40 of the upper face of the panel, forming a lower panel lip 53. Surface 52 bottoms in a slot 54.

The upper face of the panel mates with the lower face of an adjacent panel in a tongue-and-groove relationship to form a joint that slopes downwardly to prevent water from entering between the two panels. Caulking 55 is laid in the joint to form a water-tight seal.

In use, the clips are mounted in a vertical array on the upright supports. The siding panels are then slid horizontally into the clips with the inner surface of each panel abutting the bodies 20 of a pair of adjacent clips. The next panel is then mounted on the clips and tongue-and-grooved with the lower installed panel.

FIGS. 6-9 illustrate a method for forming a corner 60 from either plastic or concrete components Corner 60 includes a base block 61, a lower panel 62, and an upper, second panel 63. Base 61 has a tongue 64. Lower panel 62 has a groove 65 that mates with tongue 64, and a pair of simulated brick faces 66A and 66B, at right angles, one to the other. Lower panel 62 has a top face with a pair of intersecting tongues 67 and 68, and a pattern of slots 69.

Upper panel 63 also has a pair of intersecting simulated brick faces 70A and 70B, and grooves, not shown, that mate with tongues 67 and 68 of lower panel 62. A layer of mortar is laid between the joint of each of the mating faces of the two panels, as well as subsequent panels.

Figure 9:
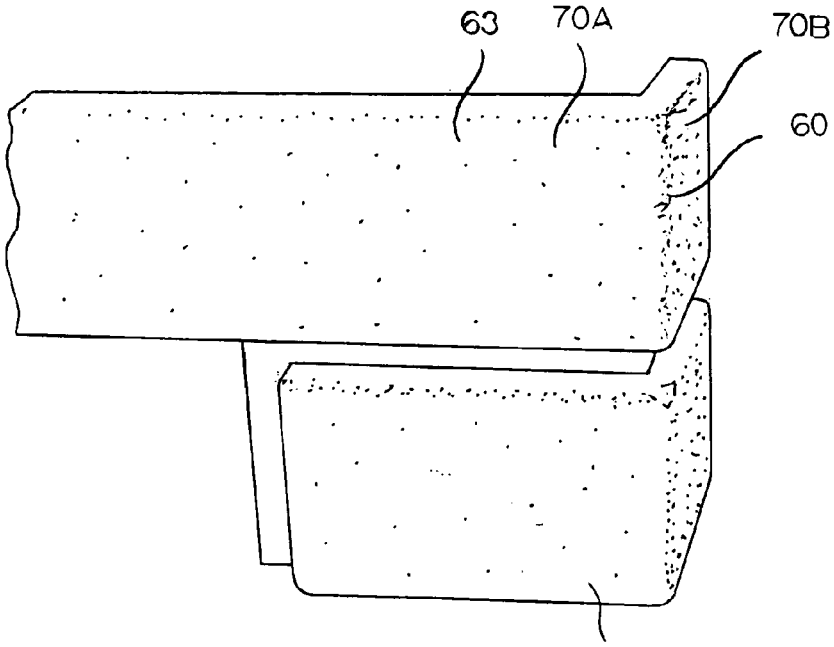

The corner faces of each panel alternate between a face that simulates the length of a brick, and the face of a neighboring panel that simulates the width of a brick, as shown in FIG. 9.

Figure 11:
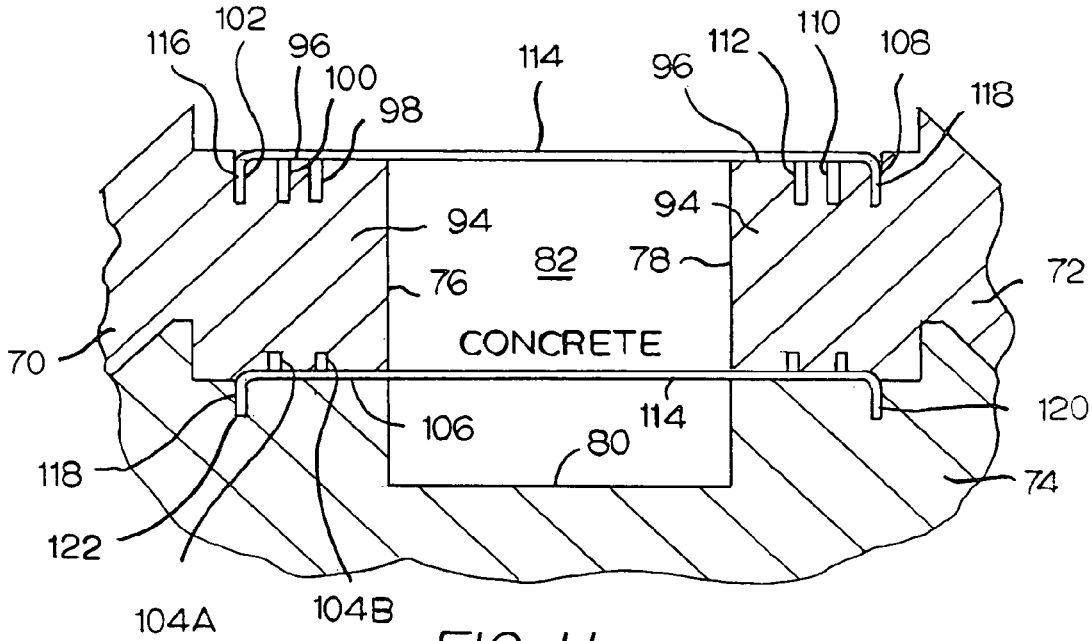
FIG. 11 is a view illustrating another embodiment of the invention employed for forming the base of a concrete wall.
Figure 12:
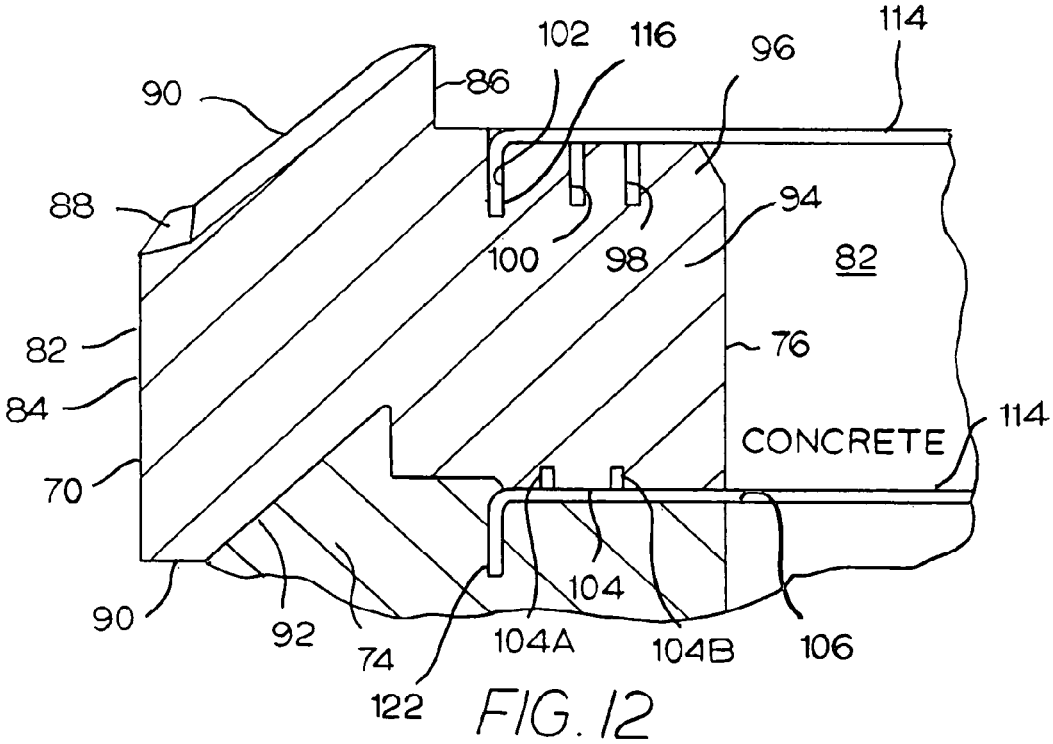
FIG. 12 is a cross-sectional view of a siding panel forming a part of the wall of FIG. 11.

FIGS. 11 and 12 illustrate another embodiment of the invention in which a pair of spaced walls 70 and 72 are assembled by mounting two series of concrete panels on concrete base 74.

The purpose of the base is to keep the brick panel system level. The base is place on a foundation, not shown, with mortar with a screw made for concrete, or a pin.

Walls 70 and 72 have inner surfaces 76 and 78 aligned with a channel 80 in base 74 to form an opening for receiving concrete 82.

Each concrete panel or block has an outer face 82 with a brick simulating coating 84. Outer face 82 is parallel to an inner face 86 at the top of the panel. Each panel has a flat narrow surface 88 that extends from the outer face of the panel and then joins an inclined upper face 90 which terminates with inner face 86. Upper face 90 forms an obtuse angle with respect to outer face 82.

The lower face of the panel has a narrow flat face 90 which terminates with an inclined face 92 that forms a tongue having an acute angle with respect to the plane of the outer face. Face 92 lies in a plane that is parallel to upper face 90 for slidably abutting an adjacent panel.

Each concrete panel has an integral body 94. Body 94 includes an inner surface 76, and an upper flat face 96 having two parallel, longitudinally extending slots 98 and 100, and a clamp-receiving slot 102. The body also has a lower surface 104 seated on either top face 106 of the base, or on the upper face of an adjacent panel. Lower surface 104 has a pair of longitudinal mortar-receiving slots 104A and 104B.

Referring to FIG. 11, wall 72 has a series of stacked panels that are identical to the panels of wall 70. Each panel includes a longitudinally extending clamp-receiving slot 108, and a pair of mortar-receiving slots 110 and 112. A ½" thick metal reinforcing clamp 114 has bent ends 116 and 118 inserted into slots 102 and 108 to prevent any separation of one wall with respect to the other. Similarly, a lower reinforcing clamp 114 has bent ends inserted into a pair of slots 120 and 122 in the base.

The thickness of wall 72 is chosen to accommodate the base and the clamp length is either thicker or thinner. For example, a factory building having a crane bridge would call for a thicker wall. The wall system can be used adjacent a freeway as a sound barrier, or in locations having ground or mud slides.

Figure 10:
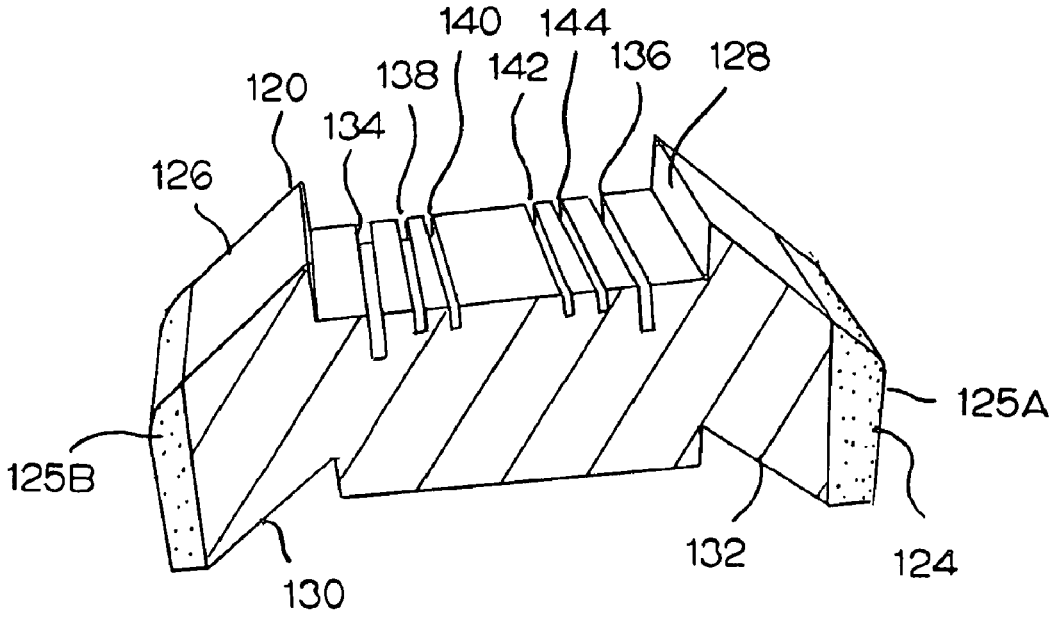
FIG. 10 illustrates a section of a concrete block having two faces.

FIG. 10 illustrates a cross-section of a concrete panel 124 having two outer brick faces 125A and 125B, a pair of spaced tongues 126 and 128 and lower tongue-receiving grooves 130 and 132.

Panel 124 has a pair of spaced, parallel clamp-receiving slots 134 and 136 adjacent tongues 126 and 128 respectively, and four parallel mortar-receiving slots 138, 140, 142 and 144. All six slots run the full length of the panel.

The panels 124 are stacked one above the other with a layer of mortar between abutting surfaces.

A reinforcing clamp 114 is mounted between each pair of panels with its bent ends 116 and 118 received in slots 134 and 136.

The concrete brick systems are similar to the plastic brick system but with the following dimensions:

2¼" by 3" by 7½" brick with one face
2¼" by 4" by 7½" brick with one face
2¼" by 6" by 7½" brick with one face
2¼" by 8" by 7½" brick with two faces
2¼" by 10" by 7½" brick with two faces Thus it is to be understood that I have described a wall structure that may be mounted either on the outer surface of a building, using clips for connecting the panels to an upright wall structure, or to form spaced walls that define an inner opening for receiving concrete to form a self-supporting wall.

Having described my invention, I claim:

1. A wall structure, comprising:

a base;

an elongated first panel disposed on the base in a horizontal position;

an elongated second panel disposed in a horizontal position on the first panel and parallel to the first panel;

a horizontal elongated third panel disposed on the base, parallel to and spaced from the first elongated panel;

a horizontal elongated fourth panel disposed on the third panel and parallel thereto;

the first panel and the second panel defining a first wall above the base;

the third panel and the fourth panel defining a second wall spaced from the first wall to form an elongated opening;

a cementitious material disposed in the opening between the first wall and the second wall;

wherein the first, second, third, and fourth panel are identical and wherein each of said panels comprise an outer face and an inner face, with a upper tapered face and a lower tapered face; wherein said upper tapered face depends from the outer face and terminates at a first flat surface, said first flat surface is proximate and parallel to the inner face and runs the length of the panel, wherein an uppermost edge of the first flat surface extends beyond an uppermost edge of the inner face to define a channel having a flat top face having a longitudinally running vertical slot therein which is adjacent and parallel to the first flat surface; wherein said lower tapered face depends from a lower end of said outer face toward the inner face parallel to said upper tapered face and terminates at a second flat surface which is co-planar with said first flat surface, the lower tapered face and second flat surface defining a groove that is complementary in shape to a profile defined by the upper tapered face and first flat surface;

further comprising a metal reinforcing member disposed at right angles to the first elongated panel and the third elongated panel, the reinforcing member having a first and second integral lip depending from opposite ends of a central elongated web, wherein said first lip is disposed in the vertical slot in said first panel and said second lip is disposed in the vertical slot of said third panel.

2. A wall structure as defined in claim 1, in which the cementatious material fills the elongated opening between the first wall and the second wall.

3. A wall structure as defined in claim 1, in which the first panel has a longitudinally running first slot, and the third panel has a longitudinally running second slot, and including a metal reinforcing member disposed at right angles to the first elongated panel and the third elongated panel, the reinforcing member having a first integral lip disposed in the first slot in the first panel, and a second integral lip disposed in the second slot in the third panel to prevent a motion of the first elongated panel with respect to the elongated third panel.

4. A wall structure as defined in claim 1, in which each outer face, having a simulated brick finish.

5. A wall structure as defined in claim 4, including a layer of mortar disposed between said first panel and said second panel.

6. A wall structure as defined in claim 4, including a layer of a caulking disposed between said first panel and said second panel.

7. A wall structure comprising:

a plurality of elongated horizontal panels, each having an outer face, an inner face and complementarily-shaped upper and lower profiles running between the outer and inner faces;

wherein said upper profile includes an upper tapered face which depends from the outer face and terminates at a first flat surface, said first flat surface is proximate and parallel to the inner face and runs the length of the panel, wherein an uppermost edge of the first flat surface extends beyond an uppermost edge of the inner face to define a horizontal channel having a flat top face running between said first flat surface and the inner face;

wherein the lower profile includes a lower tapered face which runs inwardly from the outer face toward the inner face parallel to the upper tapered face, an inward edge of the lower tapered face terminating at a second flat surface which is co-planar with said first flat surface, the lower tapered face and second flat surface defining a groove that is complementary in shape to the upper profile; and a base having a top surface with a profile which is identical to said upper profile;

wherein a first panel is mounted upon said base by mating the lower profile of the first panel upon the top surface profile to said base;

wherein a second panel is mounted upon said first panel by mating the lower profile of the second panel upon the upper profile of the first panel, such that the outer and inner faces of the first and second panels are co-planar;

wherein a third of said plurality of elongated horizontal panels is mounted upon said base with the outer and inner faces of said third panel is parallel to the inner and outer faces of the first panels with the inner faces facing each other;

wherein said first and third panels are spaced, such that said inner faces of said first and third panels define an elongated vertical opening wherein a vertical slot is formed in said flat top face adjacent and parallel to the first flat surface, further comprising a clamp member having a flat elongated web with downwardly depending legs at each end;

wherein each leg is received in said slot formed in the top face of said first and third panels.

8. A wall structure as defined in claim 7, further comprising a cementatious material filling said elongated vertical opening.

9. A wall structure as defined in claim 1, including material on said outer face forming a simulated brick thereon.

10. A wall structure comprising:

a plurality of elongated horizontal panels, each having an outer face, an inner face and complementarily-shaped upper and lower profiles running between the outer and inner faces, wherein said upper profile includes an upper tapered face which depends from the outer face and terminates at a first flat surface, said first flat surface is proximate and parallel to the inner face and runs the length of the panel, wherein an uppermost edge of the first flat surface extends beyond an uppermost edge of the inner face to define a horizontal channel having a flat top face running between said first flat surface and the inner face, and wherein the lower profile includes a lower tapered face which runs inwardly from the outer face toward the inner face parallel to the upper tapered face, an inward edge of the lower tapered face terminating at a second flat surface which is co-planar with said first flat surface, the lower tapered face and second flat surface defining a groove that is complementary in shape to the upper profile; and a base having a top surface with a pair of spaced mounting portions, each having a profile which is identical to said upper profile;

wherein a first of said elongated horizontal panels is mounted upon said base by mating the lower profile of the first panel upon one of the mounting portions;

wherein a second of said elongated horizontal panels is mounted upon said base by mating the lower profile of the second panel upon the other mounting portion, such that the inner faces of the first and second panels are parallel and facing toward each other to define a cavity;

wherein a vertical slot is formed in said flat top face adjacent and parallel to the first flat surface, said wall structure further comprising a clamp member having a flat elongated web with downwardly depending legs at each end;

wherein each leg is received in said slot formed in the top face of said first and second panels.

11. A wall structure as defined in claim 10, further comprising a cementatious material filling said cavity.

12. A wall structure as defined in claim 10, including material on said outer face forming a simulated brick thereon.

* * * * *